US007591704B2

(12) United States Patent
Kim et al.

(10) Patent No.: US 7,591,704 B2
(45) Date of Patent: Sep. 22, 2009

(54) CLOTH DOLL HEAD AND A METHOD FOR MAKING SAME

(75) Inventors: Kap Yeon Kim, Seoul (KR); Sin Dong Su, Suzhou (CN); Hwang Sun Jin, Suzhou (CN)

(73) Assignee: Ty, Inc., Westmont, IL (US)

( * ) Notice: Subject to any disclaimer, the term of this patent is extended or adjusted under 35 U.S.C. 154(b) by 410 days.

(21) Appl. No.: 11/653,554

(22) Filed: Jan. 16, 2007

(65) Prior Publication Data

US 2008/0171489 A1 Jul. 17, 2008

(51) Int. Cl.
*A63H 3/36* (2006.01)

(52) U.S. Cl. ..... 446/391; 112/475.04

(58) Field of Classification Search ..... 446/391; 132/105, 53

See application file for complete search history.

(56) References Cited

U.S. PATENT DOCUMENTS

| | | | | | |
|---|---|---|---|---|---|
| 1,070,553 | A | * | 8/1913 | Stevens | 446/372 |
| 2,309,447 | A | * | 1/1943 | Greneker | 428/16 |
| 2,391,131 | A | * | 12/1945 | Clark | 446/372 |
| 3,561,457 | A | * | 2/1971 | Duesel | 132/53 |
| 3,688,779 | A | * | 9/1972 | Greco | 132/53 |
| 3,858,591 | A | | 1/1975 | Wada | |
| 4,101,619 | A | | 7/1978 | Conway et al. | |
| 4,450,129 | A | | 5/1984 | Dunn et al. | |
| 4,616,769 | A | | 10/1986 | Steigler et al. | |
| 4,629,441 | A | | 12/1986 | Cahill | |
| 4,659,319 | A | * | 4/1987 | Blair | 446/87 |
| 4,840,603 | A | | 6/1989 | Cahill | |
| 4,892,501 | A | | 1/1990 | Girelli | |
| 5,182,844 | A | | 2/1993 | Honda | |
| 6,050,875 | A | | 4/2000 | Lee | |
| 6,527,618 | B1 | * | 3/2003 | Faunda et al. | 446/394 |

FOREIGN PATENT DOCUMENTS

| | | |
|---|---|---|
| DE | 14 78 677 | 5/1969 |
| DE | 21 54 863 | 5/1972 |
| GB | 1 264 290 | 2/1972 |
| JP | 2005 17720 | 7/2005 |

OTHER PUBLICATIONS

European Search Report Application No. EP 07 11 4044.

* cited by examiner

*Primary Examiner*—Gene Kim
*Assistant Examiner*—Matthew B Stanczak
(74) *Attorney, Agent, or Firm*—Husch Blackwell Sanders LLP Welsh & Katz

(57) ABSTRACT

A cloth doll's head and a method for manufacturing the same comprising the assembly of a soft cloth scalp cap, a soft cloth face portion, and stitching of synthetic or organic hair fibers directly to the soft cloth scalp cap. The hair and selected human facial features are embroidered, sewn, or otherwise imprinted on the outer surface of the scalp cap and face plate in a manner that is safe for a child.

14 Claims, 7 Drawing Sheets

CLOTH DOLL HEAD AND A METHOD FOR MAKING SAME

FIELD OF THE INVENTION

This invention relates to a cloth doll's head and a method for manufacturing the same.

BACKGROUND OF THE INVENTION

The cloth stuffed doll has been a favorite toy of children. Toy manufacturers seek inexpensive ways of producing a cloth stuffed doll that is safe for the child. Many dolls are undesirable because they utilize hard or removable head features that may be pulled or torn from the doll and pose a choking hazard to the child. Removable features, such as hair and plastic eyes are particularly hazardous for younger children.

One of the challenges manufacturers face in producing safe cloth stuffed dolls is ensuring the doll has features that are distinctive and attractive to children. One of the most attractive and distinctive features of the stuffed doll is the head. Children identify with the distinctive human features of the dolls head and may be particularly attracted to the doll's eyes and hair. Therefore, a toy manufacturer strives to produce cloth stuffed dolls with distinctive facial features and realistic but bright, thick, and long hair. At the same time, the toy manufacturer desires to produce a stuffed doll whose facial features and hair are secure and will not be broken or torn away from the dolls head portion.

One attractive and inexpensive partial solution is to produce a stuffed cloth doll with embroidered or sewn facial features that are bright and distinctive. Embroidered or sewn facial features provide texture and allow the manufacturer to produce dolls that vary in the color and design of the facial features simply and inexpensively. A child will be drawn to the textured and bright facial features, but there will be no attendant risk that these features will become dislodged from the head and pose a threat to the child.

While embroidering or sewing the facial features of the stuffed doll can be accomplished easily and inexpensively, producing a doll with desirable hair characteristics in such a manner to securely and effectively cover the head portion, however, has been difficult. Many stuffed dolls utilize a hard scalp portion because this makes it easier for the manufacturer to attach the hair to the doll's head while at the same time providing an opportunity for even and full hair coverage on the doll's head. Manufacturers often secure the hair to the hard scalp portion by gluing, bonding, or utilizing a root or plug style process of affixing the hair to the head. Incorporating a hard plastic scalp portion and the present method of affixing hair to the head, however, increases manufacturing costs and has the safety disadvantages previously discussed.

Manufacturers have also found it difficult to produce natural looking hair. Hair materials currently in use are often difficult to curl, have a tendency to tangle, are not easily combed, or do not possess sheen emulating natural hair. Therefore, it is desirable to produce a doll with distinctive embroidered or sewn facial features and hair that is directly sewn onto a soft cloth scalp portion of the doll providing attractive full and natural looking scalp coverage that is safe for a child.

SUMMARY OF THE INVENTION

It is an object of the present invention to provide a method for producing the head portion of a cloth stuffed doll with distinctive sewn or embroidered facial features and attractive hair that is sewn onto a soft cloth scalp portion in a manner so as to provide full and natural looking scalp coverage.

Accordingly, the foregoing objectives are provided for where a doll's head is assembled from soft cloth material. The cloth material is cut in a predetermined pattern and includes a face plate. Selected human features are imprinted on the outer surface of the face plate. The imprinted features cannot be pulled or torn from the doll and pose no choking hazard for a child. Once the face plate has been formed, cloth jaw portions are sewn to the face plate to form a face portion.

A scalp cap is formed by sewing together right, left, and center scalp portions. Thereafter, a linear hair segment is sewn to the scalp portion in an outwardly spiraling pattern with a crown of the scalp cap forming the center of the concentric rings. The linear hair segment that is sewn to the scalp cap is formed from individual hair fibers that have been assembled into hair bundles. The hair fibers of the hair bundles are comprised of a material that is amenable to holding a curl and has softness and pliability characteristics mimicking natural human hair. The hair bundles are then sewn together in such a way so as to firmly secure individual hair bundles to adjacent bundles. The linear hair segment formed in this manner is stitched securely to the scalp cap to prevent the hair from being pulled or torn from the doll.

The scalp cap is sewn to the face portion after the hair has been attached. Once the scalp cap and the face portion have been assembled, the fully assembled doll's head is turned right-side-out. The doll's head is then used to form a soft cloth doll.

BRIEF DESCRIPTION OF THE DRAWINGS

Further objects of the invention, together with additional features contributing thereto and advantages occurring therefrom, will be apparent from the following description of the invention when read in conjunction with the accompanying drawings; wherein.

DETAILED DESCRIPTION OF THE INVENTION

Figure 1:
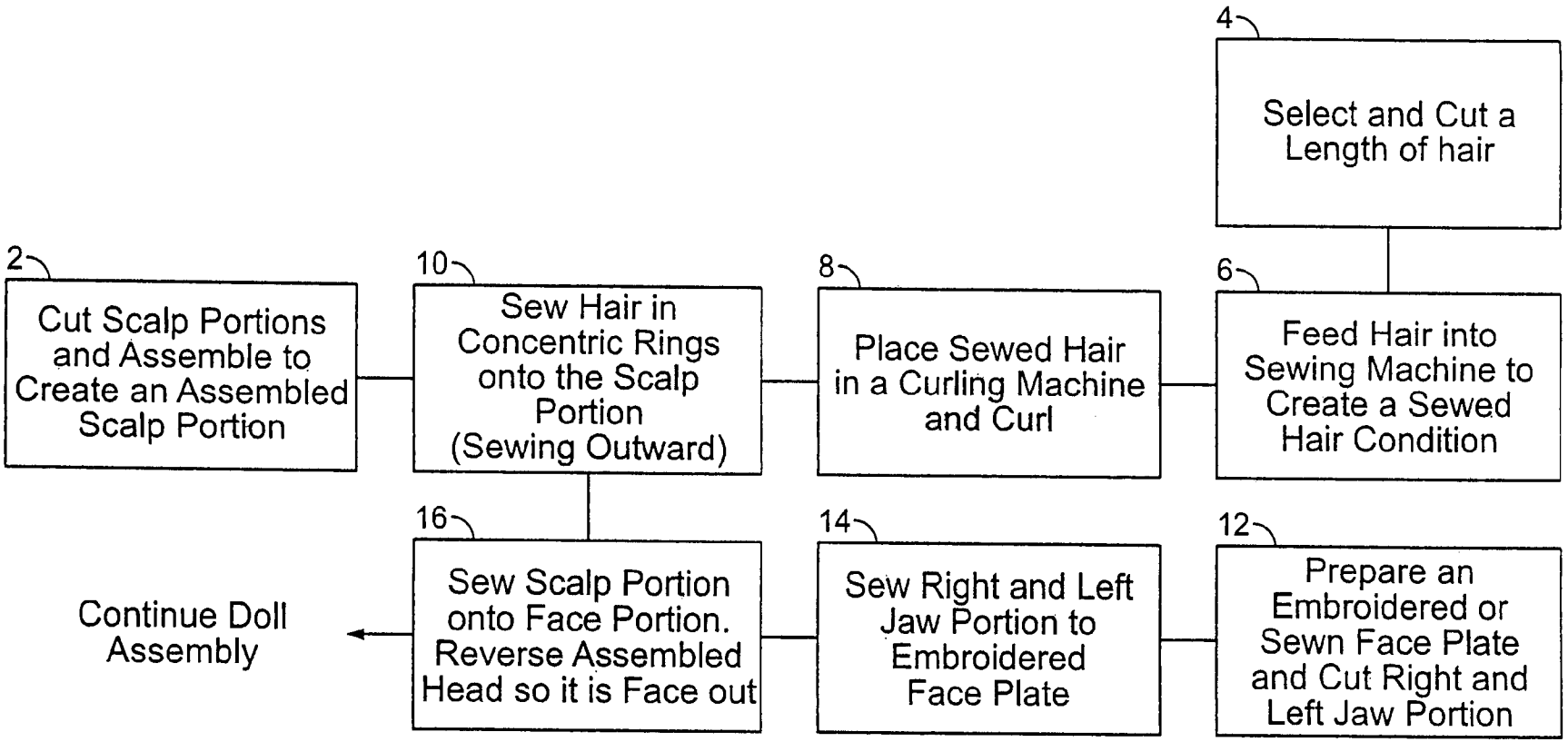
FIG. 1 depicts a block diagram indicating a manufacturing process according to one embodiment of the subject invention.

A brief description of a preferred method for producing a cloth doll's head according to the invention is provided in the block diagram of FIG. 1:

Synthetic hair is selected and prepared 4 by cutting and weighing hair fibers to an appropriate length and weight. The hair is then separated into a plurality of hair bundles and the hair bundles are then sewn and glued 6 into a linear hair segment. The linear hair segment is placed on a cylindrical roller and curled 8 by heating to a temperature and for a period of time appropriate for the hair material. Concurrently, or thereafter, a plurality of fabric scalp segments are cut in a predetermined pattern and sewn 2 forming side portions, a top portion, a back portion, and a crown. Once the linear hair segment has been formed and curled and the fabric scalp portions assembled, the linear hair segment is sewn in concentric rings onto the scalp portion 10 beginning in a circle around the crown and then sweeping in an outward spiral down.

Concurrently or thereafter, a fabric face plate is cut in a predetermined pattern and embroidered 12 to provide colorful and distinctive facial features likely to be attractive to a child. Left and right cloth head portions are cut according to a predetermined pattern and an assembled face portion is formed by sewing these head portions to the face plate 14 so as to give form and smoothness to the side and chin portions of the face plate. The assembled face portion is then sewn to the scalp portion 16 and turned right-side-out to form the fully assembled head of the cloth doll. Thereafter, the cloth doll's head can be attached to the body portion of the doll and filled with appropriate filling material.

Figure 2:
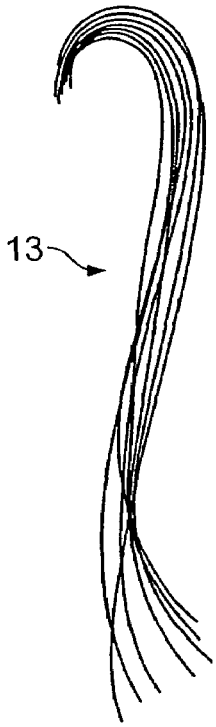
FIG. 2 depicts the raw hair material in appropriate length and weight.

A more detailed description of at least one embodiment of the method for producing the doll's head according to the invention is now provided:

Referring to FIG. 2 a quantity of synthetic doll's hair 13 is selected according to desired color and texture characteristics. In one embodiment of the invention, the hair is comprised of strands of dyed poly vinyl chloride (PVC). The advantages of manufacturing hair fibers of PVC and a method of doing the same are described in the registered Korean Patent No. 10-0529004 filed on Sep. 23, 2003 and titled Poly-Vinyl Chloride Fibers and Its Manufacturing Method. Briefly, the advantages of PVC fibers are that they possess excellent malleability characteristics, possess softness and pliability profiles similar to natural human hair, and can easily be manipulated to produce long lasting curls. These fibers can be produced, for example, by a manufacturing method which utilizes in parts by weight out of 100 parts: 2.5-3.0 organotin heat stabilizer; 0.5-1.0 lubricant; and 1.5-2.0 processing aid. These are combined to produce the dry blend (powder) which is then compounded in a screw extruder with a compression ratio of 1.9-2.1 to produce the pellets (granules). The resulting pellets or granules are extruded from the screw with a compression ratio of 2.0-2.2. While PVC fibers are preferred, it will be apparent to one skilled in the art that other synthetic and organic hair fibers may be used consistent with the scope of the present invention.

Once the hair material has been selected, the hair is cut to a desired length. The amount of hair required for any given application will vary. The circumference of the doll's head, scalp coverage, and the desired hair follicle density are important considerations when determining the required weight of hair material. In a preferred method of manufacturing a doll's head according to the invention synthetic dyed PVC hair strands are cut to a length approximating 17 centimeters and weighed to provide approximately 30 grams of the synthetic hair material. This selection will result in complete scalp coverage and follicle density that is attractive for a doll's head with a circumference approximating 6.4 to 7.6 centimeters.

Figure 3:
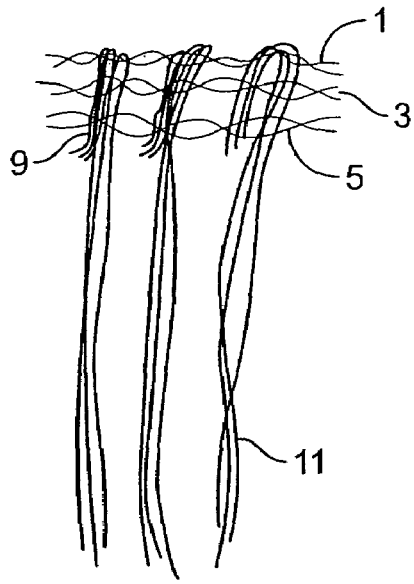
FIG. 3 depicts a section of hair following sewing operation and prior to curling.
Figure 3A:
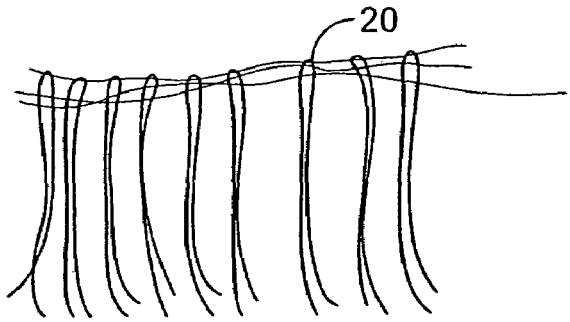
Figure 10:
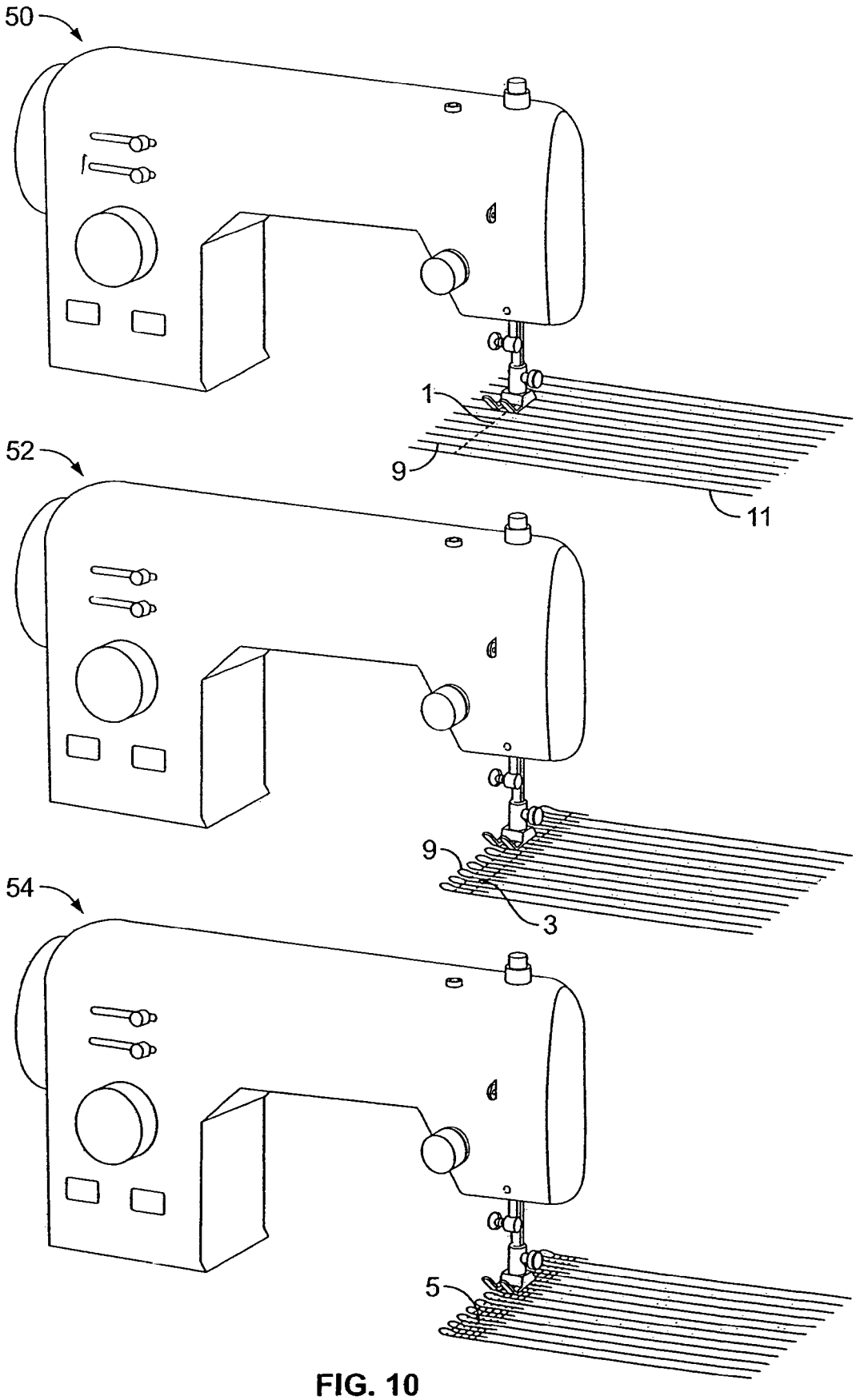
FIG. 10 depicts a sewing apparatus that can be used to sew the hair bundles into a linear hair segment.

Referring now to FIG. 3 and FIG. 10, in a preferred method according to the present invention the hair is separated into discrete hair bundles 11 approximating anywhere from 5 to 50 strands. The hair bundles 11 are sewn into a linear hair segment 20 using a 3-step sewing process. First, the hair bundles are fed into a high speed 2 needle lock stitch machine 50 and stitched 1 to allow for an approximate 2 centimeter top portion 9 above the stitch 1. The resulting hair segment is next fed into a one needle lock stitch machine 52. The top portion 9 is first folded over the first stitch 1 and a second stitch 3 is run the length of the segment. Finally, an additional one needle lock stitch machine 54 is used to run a final stitch 5 the length of the segment. In one embodiment of the invention, once stitches 1, 3, and 5 have been completed, the sewn portion of the resulting segment is glued or slightly melted and fused to secure the stitches 1, 3, and 5 and the hair bundles 11 together so they do not become disassembled later. The resulting linear hair segment 20 is depicted in FIG. 3*a*. Consistent with the scope of the present invention, alternative stitching means may be utilized that result in a linear hair segment that can be subsequently sewn to a cloth scalp cap of a doll's head as described below.

Figure 4:
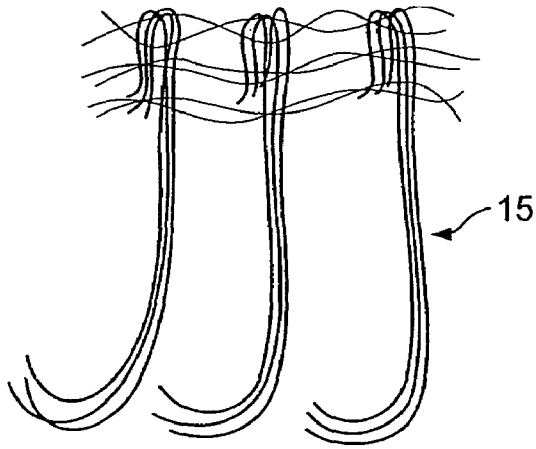
FIG. 4 depicts a section of hair after the curling process.

Referring now to FIG. 3 and FIG. 4, the linear hair segment 20 may be curled to provide for a more distinctive and attractive doll. In one method according to the invention, a dyed PVC linear hair segment 20 is heated in an YVERI M/C heat machine. The linear hair segment 20 is wrapped onto a roller and inserted into the heat machine. In a preferred embodiment of the invention, the roller is approximately 25 millimeters in diameter. The linear hair segment is heated at a temperature ranging from 65 to 70 centigrade for approximately 25 minutes.

In alternative embodiments of the invention, the temperature and heating time may be varied to produce a curl that is more or less extreme. The curling method and process may also be varied, for example, to take advantage of the unique characteristics of the material selected for the hair fibers. A temperature and time should be selected that results in adequate softening of the hair material to allow it to curl around the roller. The roller diameter may also be changed to produce more or less severe curling of the linear hair segment 20. Once the linear hair segment 20 has been heated and then cooled, the linear hair segment is in a curled condition 15 and ready to be sewn to a cloth scalp cap of a doll's head. In an alternative method consistent with the present invention, the curling step may be omitted entirely to produce a doll with straight hair.

Figure 5:
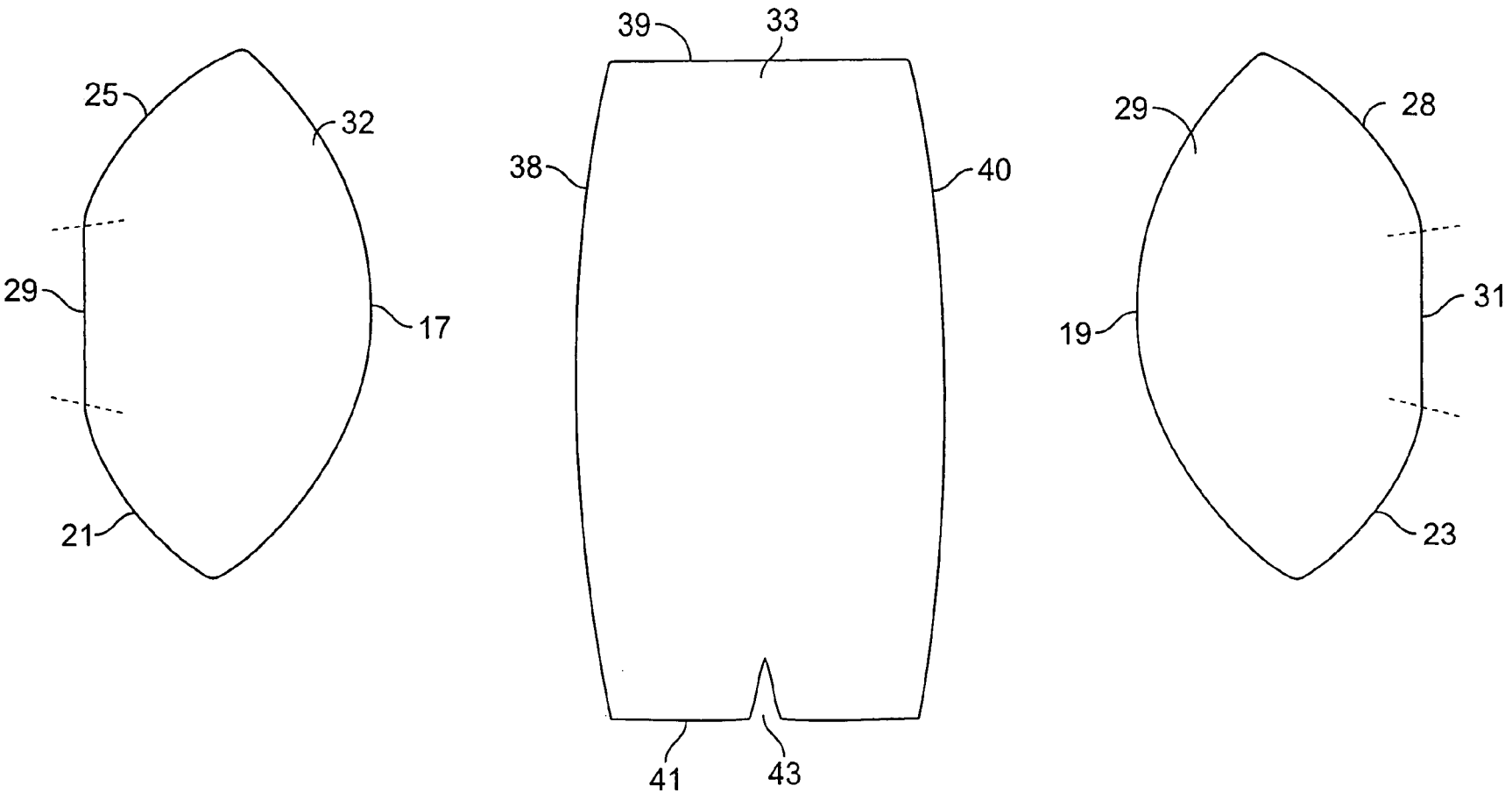
FIG. 5 depicts individual cloth scalp portions prior to combination.

Referring now to FIG. 5, a scalp cap is comprised of a right scalp portion 32, a left scalp portion 29, and a center scalp portion 33. The right, left, and center scalp portions 32, 29, and 33 have an inner and outer side. In one embodiment of the invention, the inner and outer sides of the plurality of scalp portions have different textures such that the inner sides are rough to the touch while the outer side that will be exposed to the child in the finished product has a soft and pleasant feel.

The scalp portions may be comprised of a soft cloth material such as Nylex®, treated cotton, nylon, polyester or any soft material that is preferably fire resistant and safe for children. Preferably, a cloth material is selected to allow for expansion and stretching when filling matter is placed inside the assembled doll's head. In a preferred embodiment of the invention, the cloth material is Nylex®, a tightly woven fabric that will prevent material sewn to the cloth scalp from being pulled out by a child.

Figure 9:
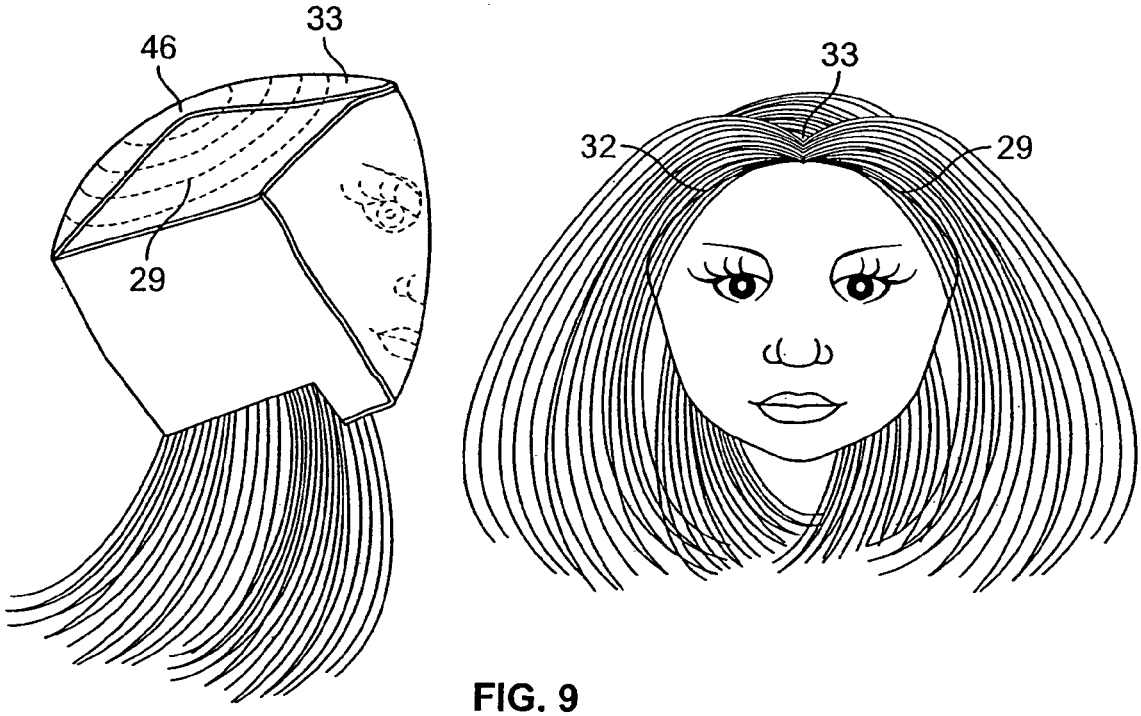
FIG. 9 depicts the final assembled face after final sewing and once it's turned right-side-out.

Referring briefly to FIG. 9, the right scalp portion 32 will be positioned on the right side of the doll's head when it is in a fully assembled state. The left scalp portion 29 will be positioned on the left side of the doll's head when it is in a fully assembled state. The center scalp portion will form the top and back of the head as shown.

Returning to FIG. 5 the right and left scalp portions 32, 28 are cut to approach a hemispherical shape 17, 19 at the side where the scalp portions are to be sewn on either side of the center scalp portion 33. Opposite the substantially hemispherical cuts 17, 19 of the right and left scalp portion 32, 28 there are upper cut portions 25,27, center cut portions 29, 31, and lower cut portions 21, 23. The upper and lower cut portions 25, 27 and 21, 23 are slightly curved while the center cut portions 29, 31 are substantially flat.

The center scalp portion has an upper cut portion 39, a lower cut portion 41, and right and left cut portions 38, 40. At the centermost region of the lower cut portion 41 of the center scalp portion 33 a triangular notch 43 is cut.

Figure 6:
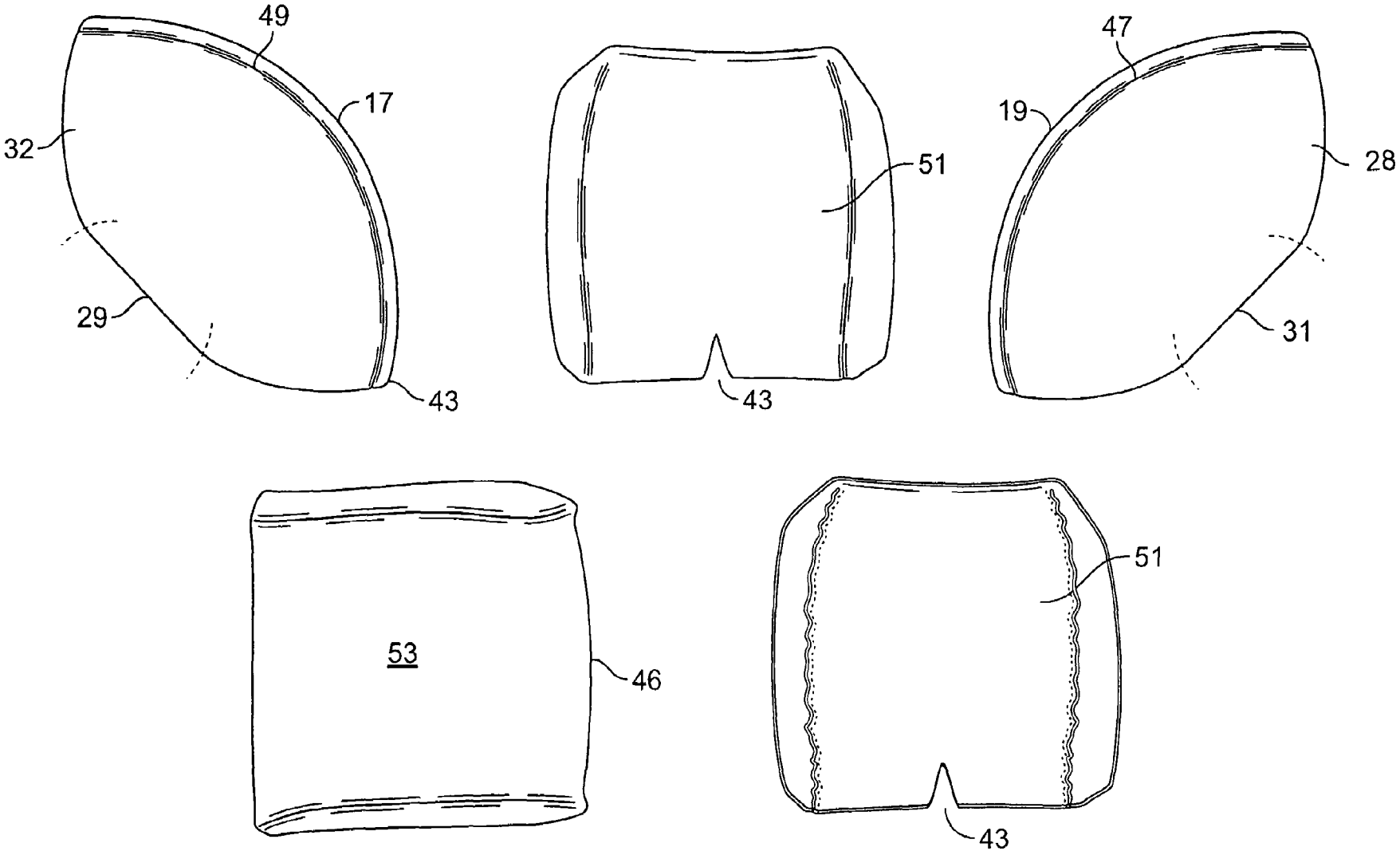
FIG. 6 depicts selected views of the assembled cloth scalp portions.

Referring now to FIG. 5 and FIG. 6, the right scalp portion 32 is sewn to the center scalp portion 33. The pieces are sewn such that the hemispherical cut portion 17 of the right scalp portion 32 is sewn to the right cut portion 38 of the center scalp portion 33. The stitching 49 should be placed at an appropriate distance from the cut edge of the right 32 and center 33 scalp portions to ensure proper mating and engagement of the scalp pieces. In a preferred embodiment of the invention, the stitch 49 is at least 0.3 centimeters from the cut edges.

The left scalp portion 29 is sewn to the center scalp portion 33 as described above. Briefly, the left scalp portion 29 is sewn to the center scalp portion 33 such that the hemispherical cut portion 19 is sewn to the left cut portion 40. The stitch 47 is placed at an appropriate distance from the cut edge to ensure proper mating and engagement of the scalp pieces. In a preferred embodiment, the stitch is placed at least 0.3 centimeters from the cut edges.

Referring now to FIG. 6, the scalp cap formed by sewing the right and left scalp portions 32, 29 to the center scalp portion 33 is depicted. The assembled scalp cap has top 53, back 51, and crown 46, portions. The center scalp portion notch 43 is located at the lowermost edge of the back portion 51. The right and left scalp portions 32, 29 in conjunction with the center scalp portion proscribe a cavity. The cut sides 17, 19, 38, 40 of the scalp portions and the stitches 49, 47 are exposed on the inner surface of the cavity. The outer surface of the cavity includes smooth seams where the scalp portions have been sewn together. The outer surface of the cavity includes smooth seams where the scalp portions have been sewn together. The outer surface of the cavity constitutes the outer surface of the scalp cap of the assembled doll's head. The assembled scalp cap proscribes a substantially hemispherical profile when viewed on the right and left faces of the scalp cap.

Figure 7:
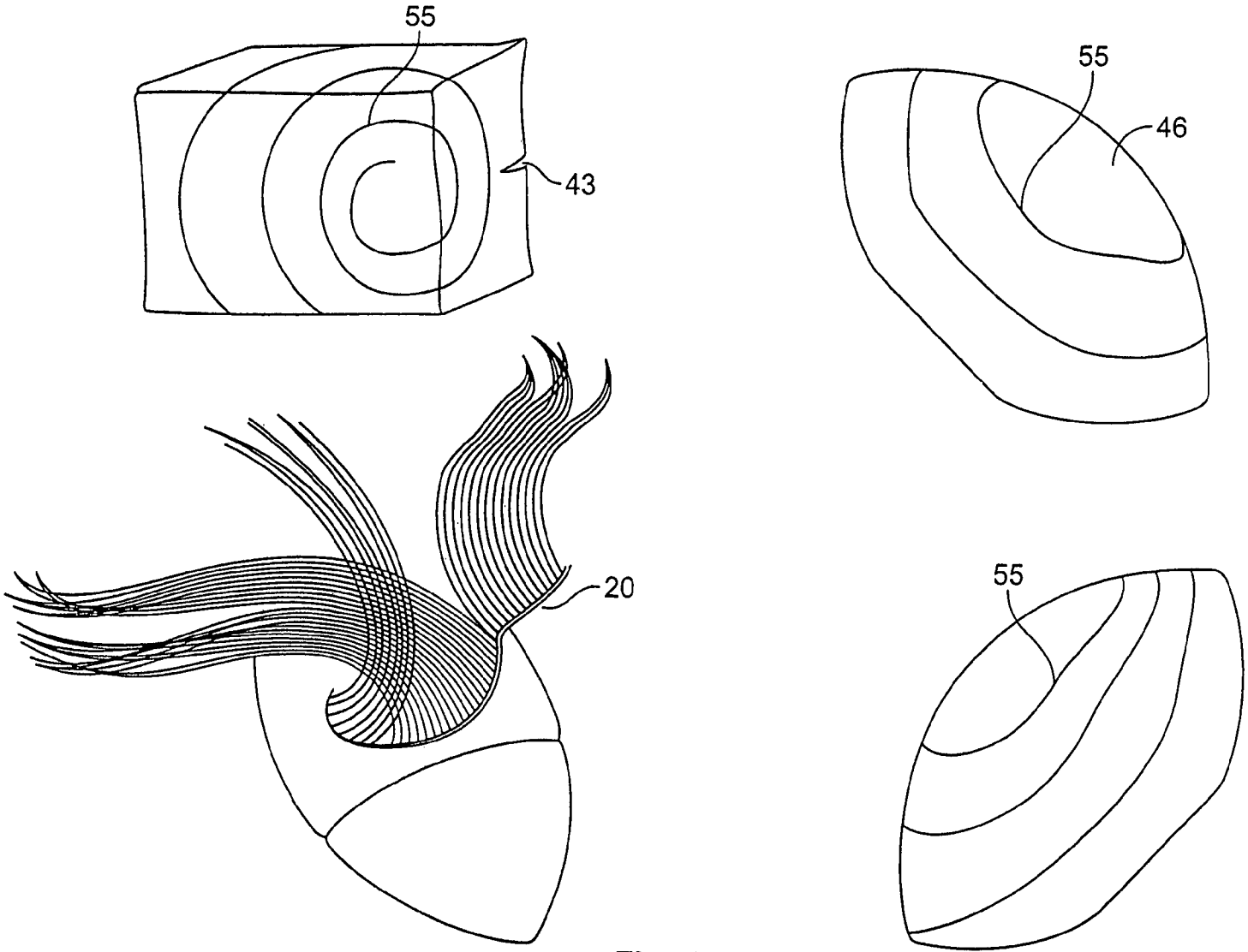
FIG. 7 depicts the sewing pattern and an example of the assembled hair portions early in the sewing state.

Referring now to FIG. 7, the linear hair segment 20 is sewn to the outer surface of the scalp cap so as to provide natural looking scalp coverage and to strengthen and secure the assembled scalp cap. A preferred sewing pattern is shown at 55. Beginning a small distance from the crown 46, the linear hair segment 20 is sewn in an outwardly spiraling fashion with the crown 46, at the center. In one embodiment of the invention, the outwardly spiraling pattern 55 is originally confined to the center scalp portion 33 and thereafter broadened to incorporate the right and left scalp portions 32, 39 so as to strengthen and secure the scalp cap. In one embodiment, the linear hair segment 20 is stitched at the upper portion 9 utilizing a high speed Post Bed Single Needle Lock Stitch machine. The stitching continues in the outwardly spiraling fashion until the entire linear hair segment 20 has been attached to the scalp cap. The density of the hair can be manipulated by sewing in a tighter or looser spiral pattern. In a preferred embodiment, sewing a linear hair segment in an outwardly spiraling pattern whereby the hair segment has previously been curled will allow the hair.

Figure 8:
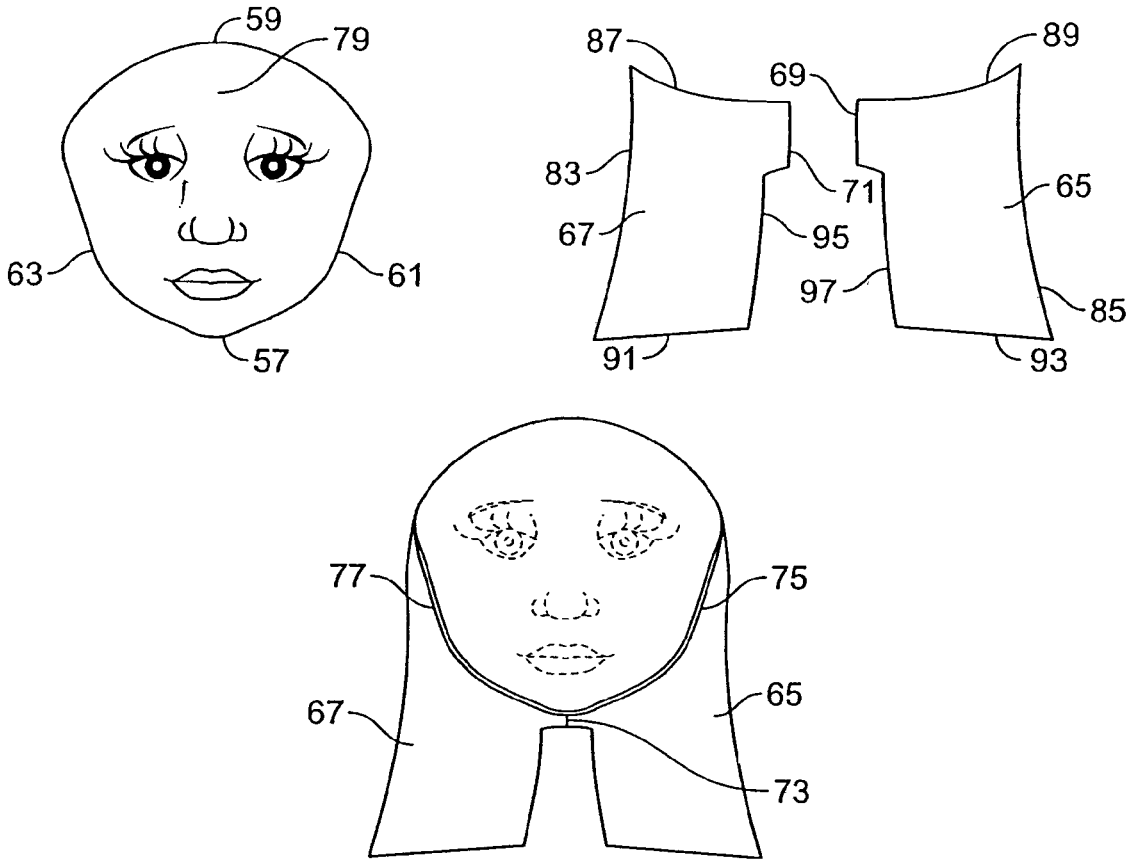
FIG. 8 depicts the embroidered and sewn face portions.

Referring now to FIG. 8, a face plate 79 is cut in a predetermined pattern from a soft cloth such as Nylex®, treated cotton, nylon, polyester or any soft material that is preferably fire resistant and safe for children. In a preferred embodiment of the invention, the material is Nylex®. The face plate has on inner and outer surface. In one embodiment of the invention, the inner and outer surfaces have different textures such that the inner surface is rough to the touch while the outer surface that will be exposed to the child in the finished product has a soft and pleasant feel. The face plate has a top cut portion 59, right and left cut portions 63 and 61, and a chin portion 57.

Selected features of a human face are formed on the outer surface of the face plate. Preferably, the pattern includes bright colors and is done in a manner that is distinctive and likely to be exciting to a child or collector. In a preferred embodiment of the invention, the human facial features are embroidered onto the outer surface of the face plate. In an alternative embodiment of the invention, the human facial features are sewn or painted onto the surface of the cloth. It will be apparent to one skilled in the art that other methods of producing a face on the face plate may be substituted and are within the scope of the invention.

Right and left jaw portions 67, 65 are cut from the same or similar fabric as the face plate. Preferably the fabric is semi-elastic to allow for expansion when filling material is introduced into the doll on assembly. In a preferred embodiment of the invention, the fabric is Nylex®.

The right and left jaw portions 67, 65 have an outer cut portion 83, 85, top cut portions 87, 89 bottom cut portions 91, 93, and inner cut portions 95, 97. At the uppermost region of the inner cut portions 95,97 tabs extend outwardly 71, 69. The jaw portions 67, 65 have inner and outer surfaces and, the inner and outer surfaces may have different textures such that the inner surfaces are rough to the touch while the outer surfaces that are to be exposed to the child in the finished product have a soft and pleasant feel.

The right and left jaw portions 67, 65 are sewn onto the face plate 79 as shown in FIG. 8. The top cut portions 87, 89 are sewn to the right and left cut portions 63, 61 of the face plate from the periphery between the top 59 and right and left cut portions 63,61 of the face plate down to the chin section 57. When the right and left jaw portions 67, 65 have been sewn to the face plate 79 as described the tabs 71, 69 meet at the chin section 57 of the face plate. The innermost tab portions are sewn together 73 to fully assemble the face portion. The stitches 77, 75, 73 of the assembled face portion are exposed on an inner surface of the face portion. The outer face portion bearing the selected human facial features constitutes the portion of the doll that is assessable to the child on the finished doll product and includes smooth seams corresponding to the area where the various jaw portions have been attached to the face plate.

Referring now to FIG. 9, the face portion and the scalp cap are sewn to fully assemble the doll's head. The scalp cap is sewn to the face portion so that the outer cut portions 83, 85 of the right and left jaw portions 65, 67 and the top cut portion 59 of the face plate 79 are sewn continuously from one side of the notch 43 at the back of the scalp portion, around the surfaces of the right and left scalp portions 29, 31 and ending the at the opposite side of the notch 43. When fully sewn, the doll's head is inside out, such that the stitching is visible on the outside of the doll's head. Turning the doll right-side-out completes the assembly of the doll's head as shown in FIG. 9. The doll's head may now be assembled on a body portion of a cloth doll and filled with material to give it substance and form.

A specific embodiment of a cloth doll head manufactured according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method for producing a cloth doll's head comprising:

cutting from a tightly woven cloth in a predetermined pattern a scalp cap comprised of a left, right, and center scalp portion;

forming the right and left scalp portions to have a hemispherical cut portion opposite an upper, lower, and center cut portion, the center cut portion being substantially flat and curving the upper and lower cut portions;

the center scalp portion having a top, lower, right and left cut portion, and cutting a notch into the centermost part of the lower cut portion;

forming an assembled scalp cap by sewing the right and left scalp portions to the center scalp portion such that the hemispherical cut portions of the right and left scalp portions are sewn to the right and left cut portions of the center scalp portion, a stitch being positioned below the periphery of the cut edges to ensure secure attachment;

forming the assembled scalp portion to have right, left, top and back portions, and an inner cavity proscribed by the right, left, top and back portions;

forming the scalp cap to have a crown indicating the upper rear location of the doll's head when in a fully assembled state;

forming the inner cavity of the scalp cap to have an inner and outer surface, a stitching visible on the inner surface of the cavity, the outer surface of the scalp cap comprising the outer surface of the doll's scalp;

forming a cloth face portion to comprise a face plate and right and left jaw portions, the face plate and right and left jaw portions having inner and outer surfaces, and outer surfaces to have the outer surface of the fully assembled doll's face;

forming the face plate to comprise a top, right, left, and chin portion, embroidering, sewing or painting the outer surface of the face to depict selected features of a human face;

forming the right and left jaw portions to have top, bottom, outer and inner cut sides, the inner cut side to have an upper and lower portion and an outwardly extending tab at the uppermost portion of the inner cut sides;

assembling the face portion by sewing the right and left jaw portions to the face plate such that the upper cut portion of the left jaw portion is sewn to the face plate from the chin portion up the left jaw portion of the face plate to the periphery between the left and top cut portions of the face place, and sewing the right jaw portion to the face plate from the chin portion up the right jaw portion of the face plate with the right and left jaw portions sewn together at the tab portion;

cutting and measuring a length of hair to be sewn onto the scalp portion; assembling individual hair strands into discrete hair bundles and sewing the discrete hair bundles into a linear hair segment;

sewing the linear hair segment to the outer surface of the scalp cap in concentric rings starting in a region surrounding the crown and sweeping in an outwardly spiraling fashion;

sewing the face portion and the scalp cap together to form an assembled head such that the top cut portion of the face plate and the outer cut portion of the right and left jaw portions are sewn from one side of the notch at the back of the scalp cap and around to the opposite side of the notch;

turning the assembled head right-side-out.

2. A method for producing a cloth doll's head according to claim 1, wherein the scalp cap is comprised of a soft cloth material.

3. A method for producing a cloth doll's head according to claim 2, wherein the face portion is comprised of a soft cloth material.

4. A method for producing a cloth doll's head according to claim 1, wherein the face portion is comprised of a soft cloth material.

5. A method for producing a cloth doll's head according to claim 1, wherein the face plate is comprised of a soft cloth material.

6. A method for producing a cloth doll's head according to claim 1, wherein the hair strands are polyvinyl chloride.

7. A method for producing a cloth doll's head according to claim 6, wherein the hair strands are dyed.

8. A method for producing a cloth doll's head according to claim 1, wherein the selected human facial features are embroidered or sewn onto the outer surface of the face plate.

9. A method for producing a cloth doll's head according to claim 1, wherein the selected human facial features are painted onto the outer surface of the face plate.

10. A method for producing a cloth doll's head according to claim 1, wherein the hair strands in the linear hair segment are curled.

11. A method for producing a cloth doll's head according to claim 10, wherein the hair strands in the linear hair segment are curled by wrapping the hair strands of the linear hair segment around a roller and heating.

12. A method for producing a cloth doll's head according to claim 11, wherein the hair strands in the linear hair segment are curled by heating for approximately 25 minutes at a temperature ranging from about 65 to 70 degrees Centigrade.

13. A method for producing a cloth doll's head according to claim 1, wherein the linear hair segment is produced by sewing the hair bundles together using three parallel stitches.

14. A method for producing a cloth doll's head according to claim 13, wherein the stitched portion of the linear hair segment is glued or melted to fuse the hair bundles and the stitches together.

* * * * *